US006510567B1

(12) United States Patent
Robbins

(10) Patent No.: US 6,510,567 B1
(45) Date of Patent: Jan. 28, 2003

(54) WHEEL CHAIR AND PLATFORM DEVICE FOR MOVEMENT OF A DISABLED PERSON FROM A WHEEL CHAIR TO A CHAIR SEAT SUPPORT IN A VEHICLE AND AIRCRAFT

(76) Inventor: Dennis L. Robbins, 2508 Sunshine Ct., Bedford, TX (US) 76021

( * ) Notice: Subject to any disclaimer, the term of this patent is extended or adjusted under 35 U.S.C. 154(b) by 0 days.

(21) Appl. No.: 09/930,025

(22) Filed: Aug. 16, 2001

(51) Int. Cl.[7] ..... A61G 7/14

(52) U.S. Cl. ..... 5/86.1; 5/81.1; 280/304.1; 297/DIG. 4

(58) Field of Search ..... 5/81.1 R, 86.1; 280/304.1; 297/DIG. 10, DIG. 4

(56) References Cited

U.S. PATENT DOCUMENTS

| | | | | | |
|---|---|---|---|---|---|
| 4,278,387 | A | * | 7/1981 | Seguela et al. | 280/250.1 |
| 4,288,124 | A | * | 9/1981 | Hamilton | 5/81.1 R |
| 4,354,791 | A | * | 10/1982 | Antonellis | 280/304.1 |
| 4,770,432 | A | * | 9/1988 | Wagner | 280/250.1 |
| 5,139,309 | A | * | 8/1992 | Kornreich | 297/145 |
| 5,207,549 | A | * | 5/1993 | Riva | 224/407 |
| 5,522,100 | A | * | 6/1996 | Schilling et al. | 5/185 |
| 5,669,620 | A | * | 9/1997 | Robbins | 280/250.1 |
| 5,746,465 | A | * | 5/1998 | Jones et al. | 296/65.03 |

FOREIGN PATENT DOCUMENTS

| | | | | |
|---|---|---|---|---|
| GB | 2068850 | * | 8/1981 | A61G/1/02 |
| GB | 0067069 | * | 12/1982 | A61G/7/10 |

* cited by examiner

*Primary Examiner*—Heather Shackelford
*Assistant Examiner*—Katherine Mitchell
(74) *Attorney, Agent, or Firm*—John E. Vandigriff

(57) ABSTRACT

A folding wheel chair assembly has at least one fold-down platform that permits the person on the seat to be moved laterally to another seat. The fold-down platform is on a mounting rod that folds upward and them may be turned to a position behind the wheel chair set out of the way when the wheel chair is being moved from one position to another. There may be a fold-down platform on each side of the wheel chair so that a person maybe moved from the wheel chair from either side. The wheel chair may include an adjustment device to raise or lower the position of the chair seat.

14 Claims, 6 Drawing Sheets

WHEEL CHAIR AND PLATFORM DEVICE FOR MOVEMENT OF A DISABLED PERSON FROM A WHEEL CHAIR TO A CHAIR SEAT SUPPORT IN A VEHICLE AND AIRCRAFT

FIELD OF THE INVENTION

This invention relates to wheel chairs, and more particularly to a collapsible wheel chair with a platform device for moving a disabled person from the wheel chair seat to a seat on a vehicle such as an automobile and to an aircraft seat.

BACKGROUND OF THE INVENTION

The Americans with Disabilities Act requires that all programs and services are available to everyone, including persons with disabilities. Many advances have been made in this respect, however with some notable exceptions. Most transportation service such as some local city buses have provisions for persons with disabilities. Many sidewalks and building entrances have been designed to provide for persons with disabilities. Notably absence is the provision for moving persons into and out of an aircraft.

U.S. Pat. No. 4,278,387, discloses a device for transferring a handicapped person from a wheel or handicap chair. A pair of tracks are extendable from a motor vehicle. The pair of tracks extend from the motor vehicle, engage the seat on the wheel chair, and then retract into the motor vehicle to move the seat into the motor vehicle.

U.S. Pat. No. 4,354,791, discloses a wheel chair construction which includes a seat that is laterally movable on a pair of tracks that engage a similar set of tracks for moving a handicapped person from the wheel chair. The seat has rollers that roll in the tracks. The person is manually moved laterally with the rollers and tracks.

U.S. Pat. No. 4,266,305, discloses a seat on at wheel chair that is movable backward to position the seat over a toilet seat.

SUMMARY OF THE INVENTION

The invention is to a folding wheel chair assembly and at least one fold-down platform that permits the person on the seat to be moved laterally to another seat. The fold-down platform is on a mounting rod that folds upward and them may be turned to a position behind the wheel chair seat out of the way when the wheel chair is being moved from one position to another. There may be a fold-down platform on each side of the wheel chair so that a person maybe moved from the wheel chair from either side.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
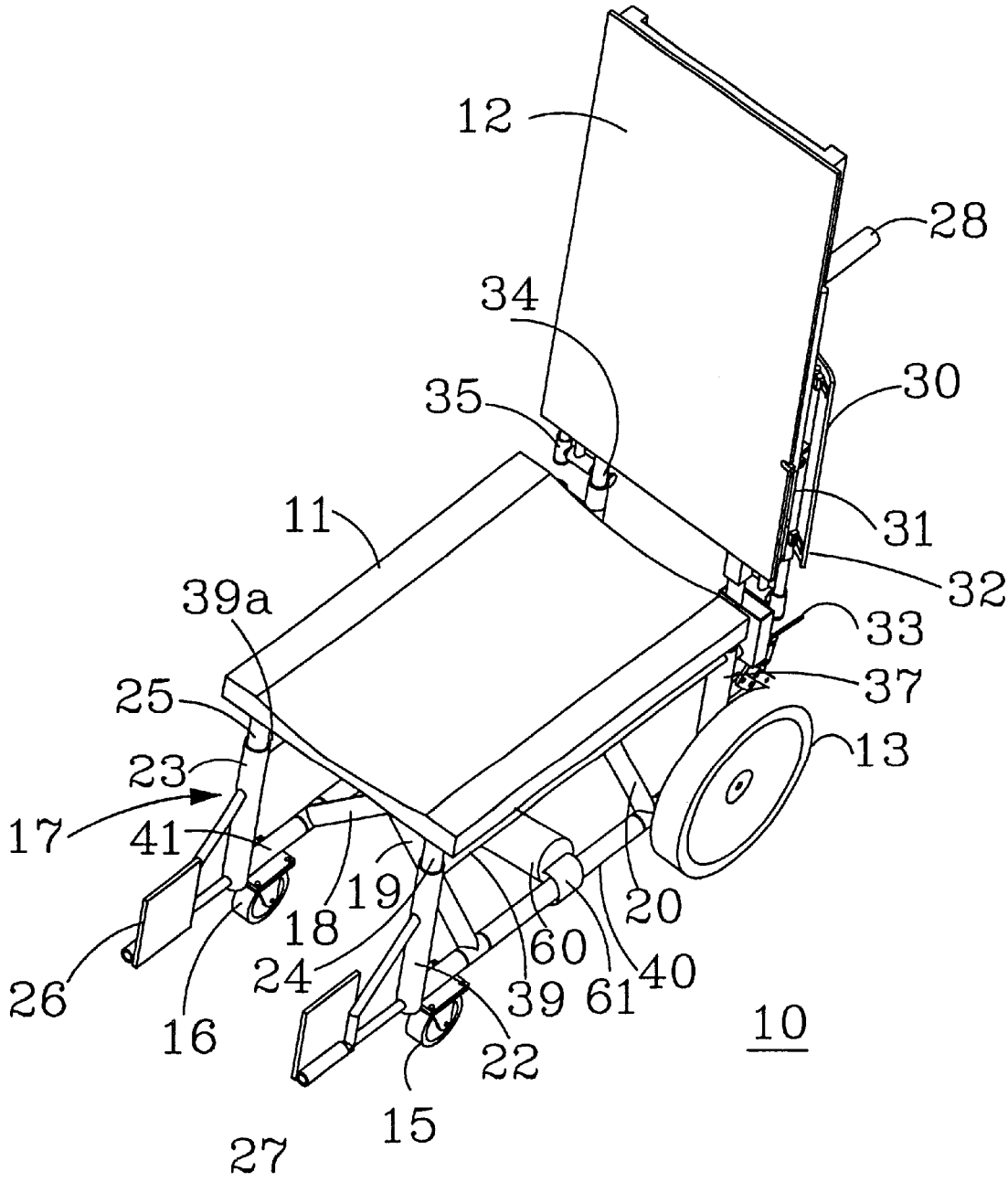
FIG. 1 shows a folding wheel chair of the present invention with transfer platforms.

FIG. 1 Shows the folding wheel chair 10 of the present invention. Chair 10 has a seat 11 and a back 12 mounted on a frame 17. Seat 11 and back 12 may be of a flexible material such as a canvas, cloth or plastic to allow folding of the chair. Frame 17 has two seat supports 39 and 39*a* mounted between vertical supports 22 and 23 in the front, and 37 and 38 (FIG. 2) in back. The vertical supports 22,37, 23 and 38 are mounted on two horizontal supports 40 and 41, respectively. Cross supports 18 and 19 in front, and 29, 21 in back are connected between the upper supports 39 and 39*a*, and lower supports 40 and 41. Supports 18 and 19 are secured by a pin so that they pivot to allow the chair to be folded. Only pin 21*a* is illustrated in FIG. 2.

The chair is mounted on four wheels, two front wheels 15 and 16, and two larger back wheels 13 and 14. Foot rests 26 and 27 are mounted, one each on supports 22 and 23. There is a wheel lock 33 on each of the rear wheels. Wheel lock 33 is shown in FIG. 1.

A height adjustment mechanism 60 is shown connected to lower support 40 and is described in more detail below.

Figure 2:
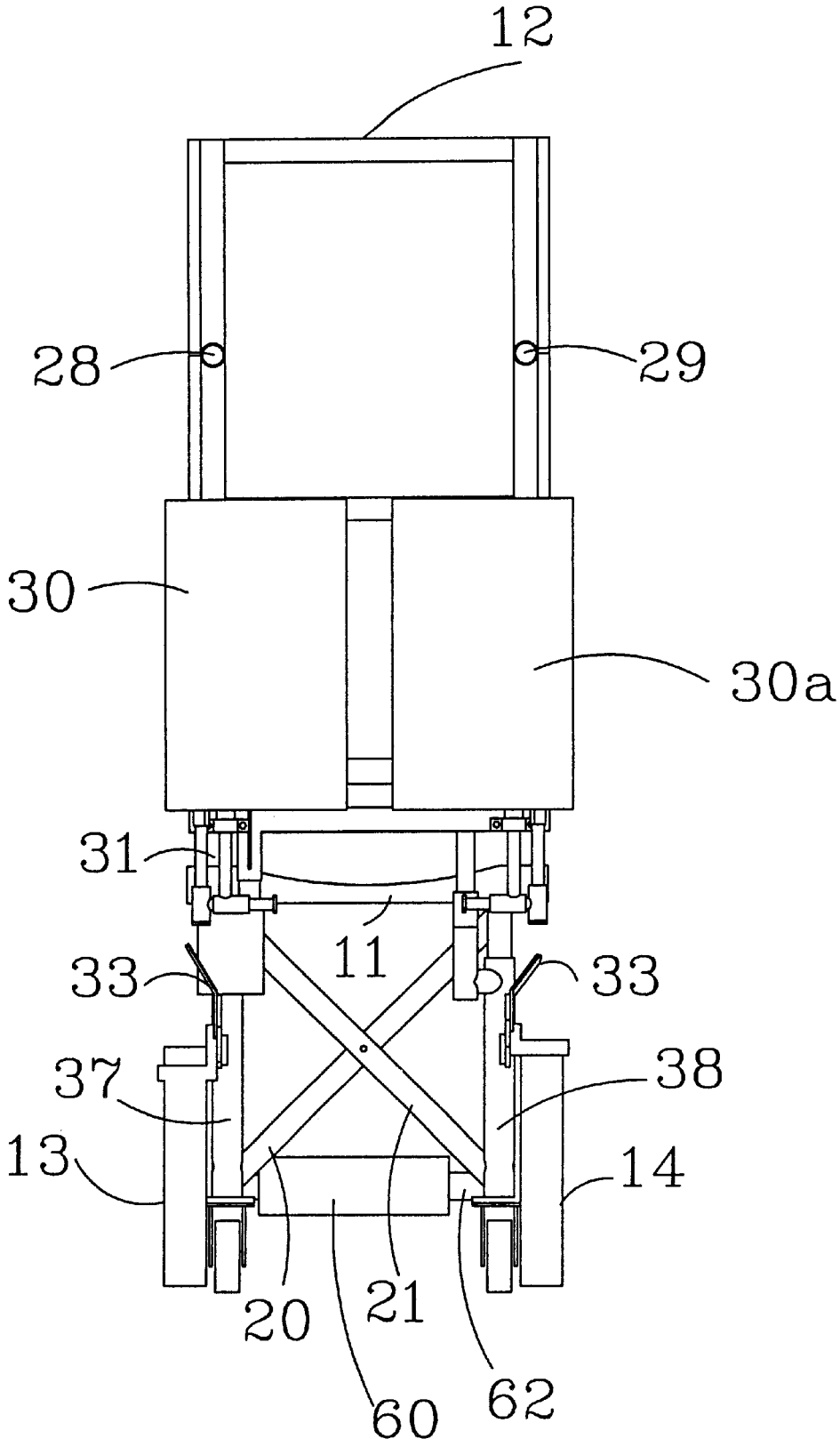
FIG. 2 shows the back side of a wheel chair of the present invention with two transfer platforms folded in a stored position.

FIG. 2 is a back view of chair 10 showing transfer platforms 30 and 30*a* folded against the back of the chair. Two handles 28 and 29 are mounted on the back to assist in moving the chair. Pivot pin 21*a* is shown that connects cross braces 20 and 21, allowing the chair to be folded, the sides toward the middle.

The hydraulic height adjustment device 60 is shown extending between lower braces 40 and 41 (FIG. 1).

Figure 3:
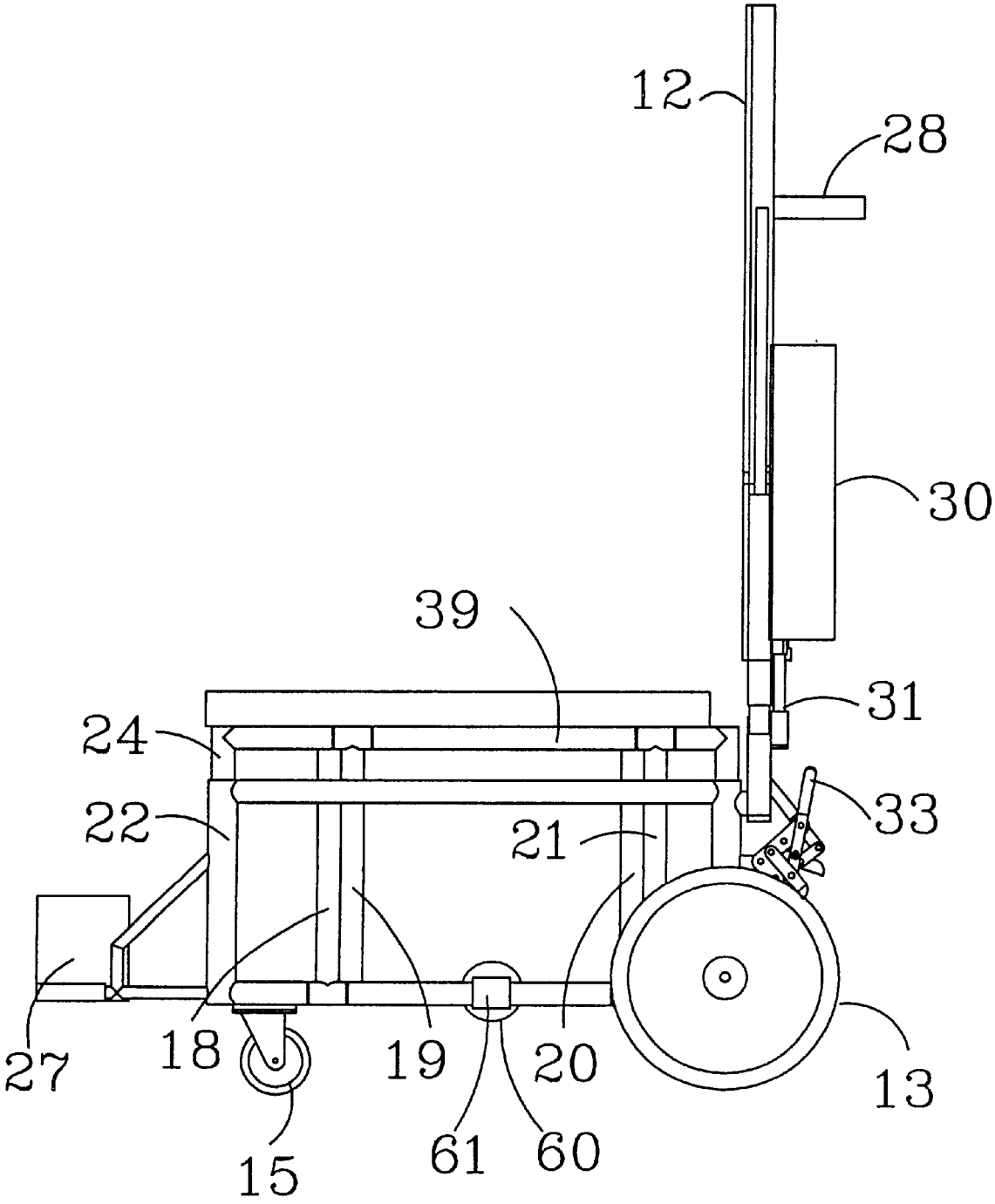
FIG. 3 shows a side view of the wheel chair of the present invention with the transfer platforms folded in a stored position.

FIG. 3 is a side view of chair 12 showing the basic parts of the chair with the transfer board folded to the back of the chair back. Brake 33 may be engaged when the chair is in a stopped position.

Figure 4:
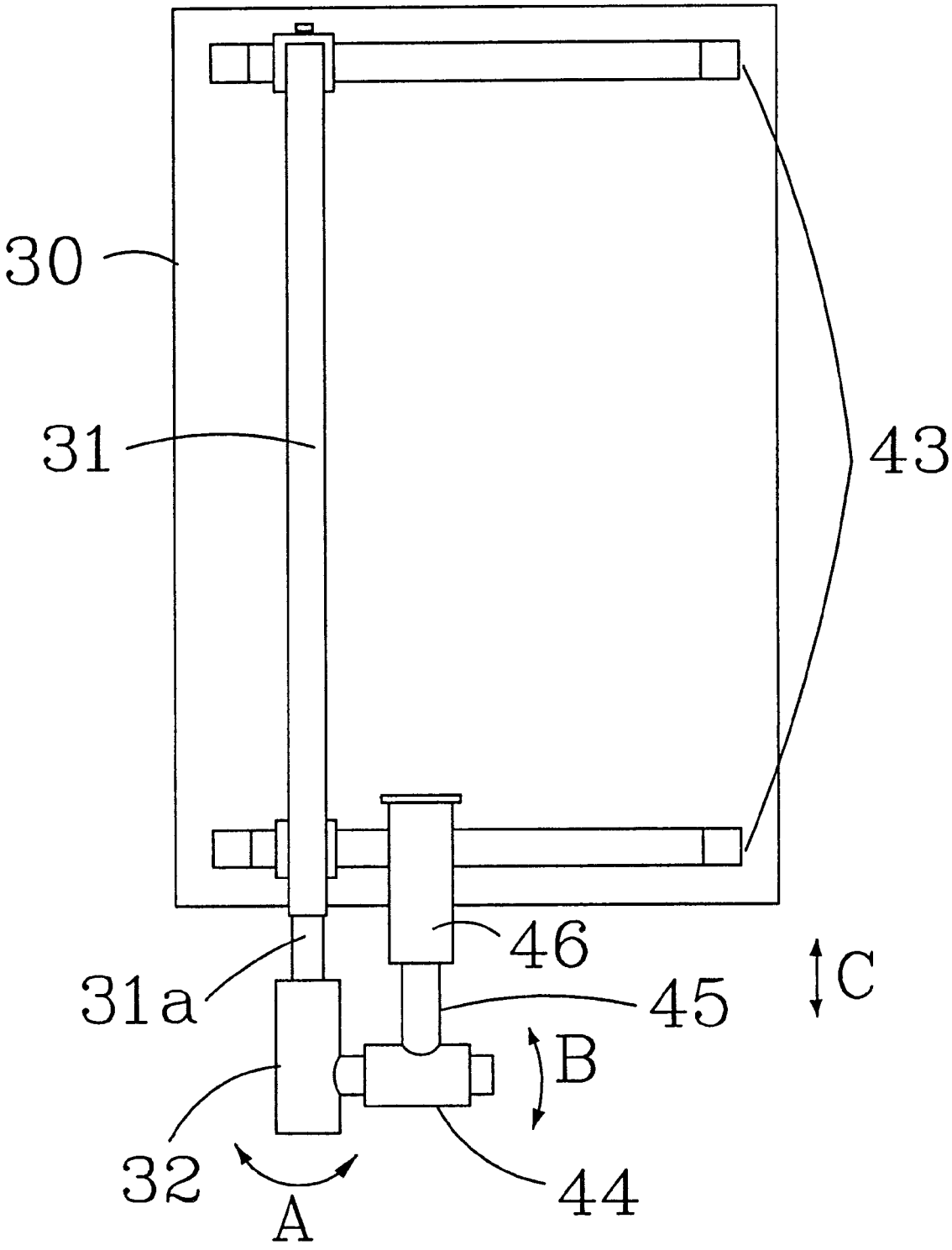
FIG. 4 shows the platform mechanism.

FIG. 4 is a detailed illustration of the transfer board. Transfer board 30 is attached to two sliding rails 43 which are in turn slidably attached to boom 31. Boom 31 has an end 31*a* that is rotatably mounted in an pivot 32, as shown by arrow A. Pivot 32 is rotatably mounted in pivot mount 44, and rotates as shown by arrow B. Mounted in pivot mount 44 is attachment sleeve 46 and slide 45. Sleeve 46 is attached to the back of the wheel chair, and slide 45 is movable in sleeve 46 to adjust its vertical position as shown by arrow C.

Figure 5:
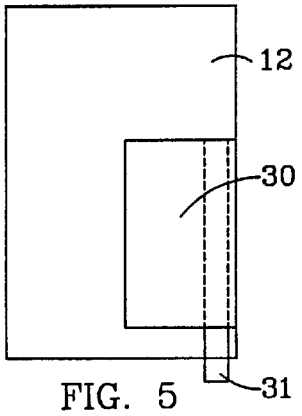
FIG. 5 is a simplified view of the back of the wheel chair seat and transfer platform.
Figure 7:
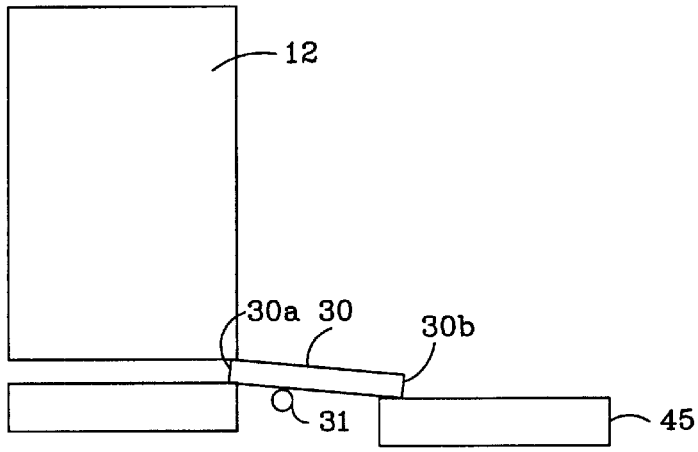
FIG. 7 is a simplified back view of the wheel chair seat, transfer platform and an aircraft seat.
Figure 6:
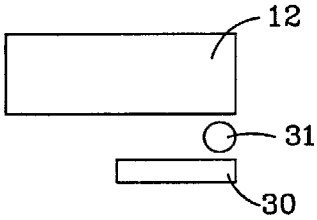
FIG. 6 is a simplified top view of the sear back and transfer platform.
Figure 8:
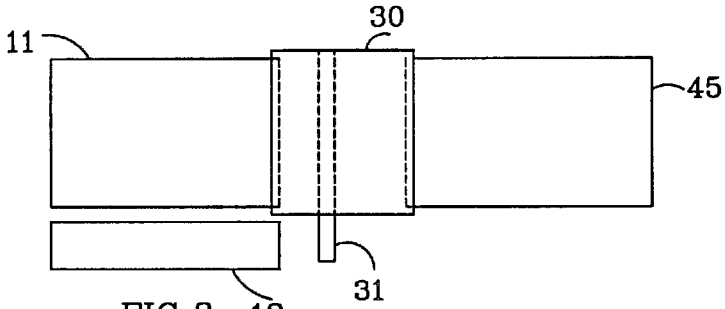
FIG. 8 shows a simplified top view of FIG. 6.

FIGS. 6–8 are simplified illustrations of the various positions of the transfer board. In FIG. 5, the wheel chair back seat 12 is shown with the transfer board 30 and transfer boom in a stored position. In FIG. 6, a top view is shown of FIG. 5 with the transfer board 30 and boom 31 behind seat back 12.

FIGS. 7 and 8 show the transfer board 30 in position to transfer a person from the wheel chair to an adjacent seat, for example an aircraft seat. In FIG. 7 transfer seat has been rotated around the back 12 of the wheel chair and lowered to place one edge 30*a* on the wheel chair seat 11 and one edge 30*b* on the edge of the aircraft seat. The person on the wheel chair, or on the aircraft seat may be moved horizontally to the adjacent, either the wheel chair or aircraft seat. In FIG. 8, it may be seen that the transfer board 31 forms a bridge across which the person may be moved by sliding so that the person does not have to be physically lifted.

Figure 9:
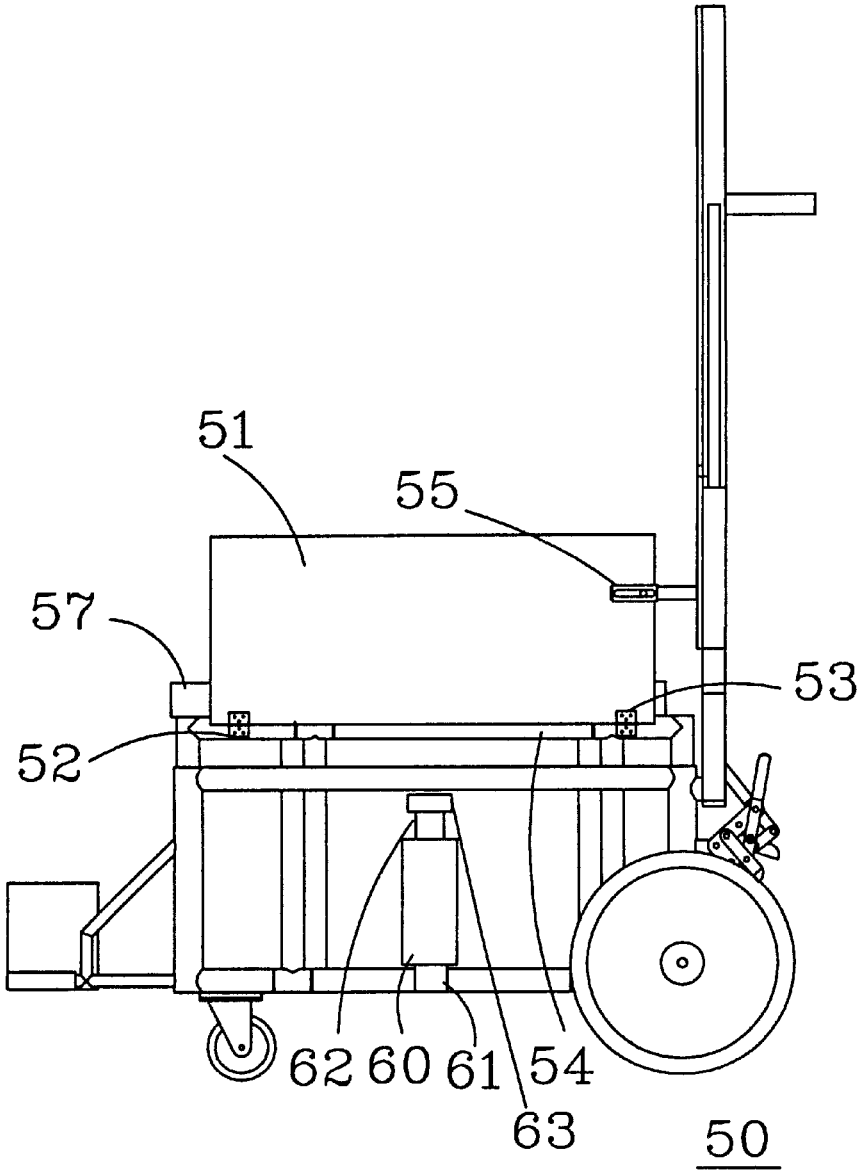
FIG. 9 shows another embodiment of the invention in which the transfer platform is mounted on the side of the wheel chair.

FIG. 9 shows another embodiment of the invention in which the transfer platform is mounted on the side of the wheel chair 50. Transfer platform 51 is mounted, for example, on chair seat support 54 by hinges 52 and 52 so that it may be moved downward adjacent to seat 58. Transfer platform 51 will bridge between seat 58 and another set, for example as illustrated in FIGS. 5 and 6, so that a person may be transferred from or to seat 58. When not being used, transfer platform is held in a vertical position by slide latch 55. Transfer platform 51, in the embodiment, may also be used as an arm rest, an/or help retain a person in seat 57.

The hydraulic adjustment cylinder 60 is shown in a vertical, stored position.

Figure 10:
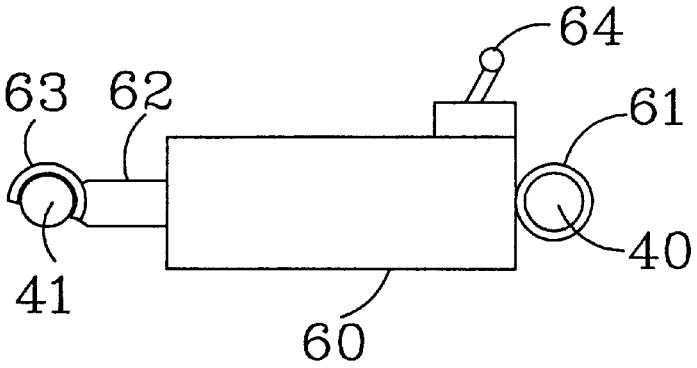
FIG. 10 shows the hydraulic mechanism for adjusting the wheel chair height.

FIG. 10 shows the hydraulic height adjustment device 60 which is rotatably mounted on lower brace 40. Device 60 is rotatably mounted on brace 40 by a collar 61. Device 60 may be stored in a vertical position as shown in FIG. 9, or may be lowered in a horizontal position with the collar 63 engaging lower brace 41. As lever 64 is moved to move cylinder 62 in or out of device 60, the lower braces are moved closer together or further apart to respectively, raise or lower the position of the chair seat. The raising or lowering permits the chair seat to be placed on a level plane with the seat onto which a person in the chair is to be moved.

What is claimed is:

1. A wheel chair and transfer platform for transferring a person from or to the wheel chair, comprising:

a wheel chair base including wheels;

a seat and back;

at least one transfer platform mounted behind the wheel chair back and attached to a rotatable support for moving the transfer platform from behind the back to a position along one side the wheel chair seat.

2. The wheel chair and transfer platform according to claim 1, including a second transfer platform on a side of the wheel chair on a side opposite said at least one transfer platform.

3. The wheel chair and transfer platform according to claim 1, wherein said transfer platform is mounted on sliding rails.

4. The wheel chair and transfer platform according to claim 3, wherein said sliding rails position the transfer platform between the wheel chair and an adjacent seat.

5. The wheel chair and transfer platform according to claim 1, wherein said transfer platform has opposite edges, each rests upon one of the wheel chair seat and an adjacent seat when in a lowered position.

6. The wheel chair and transfer platform according to claim 1, including a mechanism to adjust the height of the chair seat.

7. A wheel chair and transfer platform for transferring a person from or to the wheel chair, comprising:

a wheel chair base including wheels;

a seat and back;

a pair of transfer platforms mounted behind the wheel chair back and attached to rotatable supports for moving each transfer platform from behind the back to a position along opposite sides of the wheel chair seat.

8. The wheel chair and transfer platform according to claim 7, wherein each transfer platform is mounted on sliding rails.

9. The wheel chair and transfer platform according to claim 7, wherein said sliding rails position the transfer platform between the wheel chair and an adjacent seat.

10. The wheel chair and transfer platform according to claim 7, wherein said each transfer platform has opposite edges, each rests upon one of the wheel chair seat and an adjacent seat when in a lowered position.

11. The wheel chair and transfer platform according to claim 7, including a mechanism to adjust the height of the chair seat.

12. A wheel chair and transfer platform for transferring a person from or to the wheel chair, comprising:

a wheel chair base including wheels;

a seat and back;

a pair of transfer platforms one each, mounted on each side of the seat, at the base of opposite sides of the seat, and each platform is hinged to permit it to be rotated downward in a plane common with the seat.

13. The wheel chair and transfer platform according to claim 12, including a latch to hold each transfer platform in a vertical position when not being used to transfer a person.

14. The wheel chair and transfer platform according to claim 12, including a mechanism to adjust the height of the chair seat.

* * * * *